US009391359B2

(12) United States Patent
Liu et al.

(10) Patent No.: US 9,391,359 B2
(45) Date of Patent: Jul. 12, 2016

(54) ELECTRONIC DEVICE

(71) Applicants: Shih-Chia Liu, Taipei (TW); Chieh-Tsao Hwang, Taipei (TW); Kuo-Chiang Hung, Taipei (TW); Li-Chun Lee, Taipei (TW); Ching-Fu Yang, Taipei (TW); Chung-Yi Kao, Taipei (TW)

(72) Inventors: Shih-Chia Liu, Taipei (TW); Chieh-Tsao Hwang, Taipei (TW); Kuo-Chiang Hung, Taipei (TW); Li-Chun Lee, Taipei (TW); Ching-Fu Yang, Taipei (TW); Chung-Yi Kao, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 119 days.

(21) Appl. No.: 13/854,971

(22) Filed: Apr. 2, 2013

(65) Prior Publication Data

US 2013/0307737 A1 Nov. 21, 2013

Related U.S. Application Data

(60) Provisional application No. 61/648,609, filed on May 18, 2012.

(51) Int. Cl.

| | |
|---|---|
| ***H01Q 1/24*** | (2006.01) |
| ***H01Q 13/10*** | (2006.01) |
| ***H01Q 1/44*** | (2006.01) |
| ***H01Q 1/22*** | (2006.01) |

(52) U.S. Cl.

CPC ..... *H01Q 1/241* (2013.01); *H01Q 1/2266* (2013.01); *H01Q 1/44* (2013.01); *H01Q 13/10* (2013.01)

(58) Field of Classification Search

CPC ..... H01Q 1/44; H01Q 1/2258; H01Q 1/2266

See application file for complete search history.

(56) References Cited

U.S. PATENT DOCUMENTS

| | | | | |
|---|---|---|---|---|
| 7,339,533 | B2 | 3/2008 | Kurashima et al. | |
| 2008/0143613 | A1 | 6/2008 | Iwai et al. | |
| 2009/0033551 | A1 | 2/2009 | Hsu et al. | |
| 2010/0207826 | A1 * | 8/2010 | Ryou et al. | 343/702 |
| 2010/0328166 | A1 * | 12/2010 | Ohguchi | H01Q 1/2266 343/702 |

FOREIGN PATENT DOCUMENTS

| | | |
|---|---|---|
| JP | 2006042042 | 2/2006 |
| TW | I350027 | 10/2011 |

OTHER PUBLICATIONS

"Office Action of Taiwan Counterpart Application", issued on Aug. 4, 2015, p. 1-p. 5.

Office Action of Co-pending U.S. Appl. No. 14/140,484, issued on Oct. 26, 2015, p. 1-p. 15.

* cited by examiner

*Primary Examiner* — Robert Karacsony

(74) *Attorney, Agent, or Firm* — Jianq Chyun IP Office

(57) ABSTRACT

An electronic device including a first casing, a second casing, at least one first connecting unit and at least one feeding unit is provided. The first casing includes a conductive material. The second casing includes a conductive material. The first casing and the second casing are conducted with each other through the first connecting unit. The feeding unit is electrically connected to the first casing and the second casing, wherein the electronic device forms an antenna structure with the first casing, the second casing, the first connecting unit and the feeding unit and transmits an electromagnetic signal via the feeding unit.

10 Claims, 4 Drawing Sheets

ELECTRONIC DEVICE

CROSS-REFERENCE TO RELATED APPLICATION

This application claims the priority benefits of U.S. provisional application Ser. No. 61/648,609, filed on May 18, 2012. The entirety of the above-mentioned patent application is hereby incorporated by reference herein and made a part of this specification.

BACKGROUND

1. Field of the Application

The invention relates to an electronic device, and more particularly, to an electronic device capable of transmitting and receiving an electromagnetic signal.

2. Description of Related Art

Following the advancement of technology, current mass communication means have gradually been changed to wireless communication; devices such as smart phone, tablet PC with wireless Internet access, notebook computer and so forth are all fall within the scope of wireless communication; and in general, the wireless communication requires the use of an antenna to transmit messages.

Under a condition that a design of the electronic device is increasingly become light and thin, if the electronic device has a metal shell, the antenna, in case of limited configuration space, is more difficult to be configured away from the metal shell, thereby causing the signal of the antenna to be influenced by the metal shell. For example, most antenna of the notebook computer is disposed at a display screen thereof, and the display screen has the metal shell. In order to prevent the antenna from being too close to the metal shell and influence a transmission and reception of the signal, the antenna has to be installed at a peripheral portion of the display screen. As such, the configuration of the antenna is being limited and a difficulty in designing the antenna is increased.

SUMMARY OF THE APPLICATION

The invention provides an electronic device having favorable signal transmission and reception ability.

The electronic device of the invention includes a first casing, a second casing, at least one first connecting unit and at least one feeding unit. The first casing includes a conductive material. The second casing includes a conductive material. The first casing and the second casing are conducted with each other through the first connecting unit conducts. The feeding unit is electrically connected to the first casing and the second casing, wherein the electronic device forms an antenna structure with the first casing, the second casing, the first connecting unit and the feeding unit and delivers an electromagnetic signal via the feeding unit.

In an embodiment of the invention, a lateral side of the first casing and a lateral side of the corresponding second casing have a gap there between, and the first connecting unit and the feeding unit are disposed at in the gap.

In an embodiment of the invention, each lateral side has a distal end, the distal end is adjacent to the first connecting unit, and a distance between the first connecting unit and the distal end of each lateral side equals to $(n\times\lambda)/4$, wherein n is an integral number, and $\lambda$ is a wavelength of the electromagnetic signal.

In an embodiment of the invention, the electronic device further includes at least one second connecting unit, wherein the second connecting unit conducts the first casing and the second casing with each other, and the first casing, the second casing, the first connecting unit and the second connecting unit form a slot there between.

In an embodiment of the invention, a length of the slot equals to $(n\times\lambda)/2$, wherein n is an integral number, and $\lambda$ is a wavelength of the electromagnetic signal.

In an embodiment of the invention, the feeding unit includes a base body, a conductive element and an elastic element. The base body is disposed within the second casing. The conductive element is disposed on the base body, wherein a first end of the conductive element is in contact with the first casing, and a second end of the conductive element is connected to a feed line. The elastic element is connected between the base body and the second casing, wherein the conductive element is in continuous contact with the first casing via an elastic force of the elastic element.

In an embodiment of the invention, the first end of the conductive element is a spherical structure, a pillar structure or a sheet structure.

In an embodiment of the invention, the conductive element includes an elastic structure.

In an embodiment of the invention, the base body includes a conductive material, and the base body is connected to a ground wire and in contact with the second casing.

In an embodiment of the invention, the feeding unit further includes an insulating element, a portion of the conductive element is located within the base body, and the insulating element is filled in the base body so as to electrically isolate the conductive element from the base body.

In an embodiment of the invention, the first connecting unit is a pivoted unit, and the first casing and the second casing are pivoted with each other via the pivoted unit.

According to the foregoing, the electronic device of the invention conducts the first casing and the second casing with each other through the first connecting unit, and is configured with the feeding unit that connects the first casing and the second casing, so as to transmit and receive the electromagnetic signal via the antenna structure formed by the first casing, the second casing, the first connecting unit and the feeding unit, and to deliver the electromagnetic signal via the feeding unit. As a result, the electronic device is not required to be configured with an additional antenna, and may avoid the conductive first casing and second casing from causing interference to a signal of the additional antenna, so as to enhance the signal transmission and reception ability of the electronic device.

In order to make the aforementioned and other features and advantages of the present application more comprehensible, several embodiments accompanied with figures are described in detail below.

BRIEF DESCRIPTION OF THE DRAWINGS

The accompanying drawings are included to provide a further understanding of the application, and are incorporated in and constitute a part of this specification. The drawings illustrate embodiments of the application and, together with the description, serve to explain the principles of the application.

DETAILED DESCRIPTION OF DISCLOSED EMBODIMENTS

Figure 1:
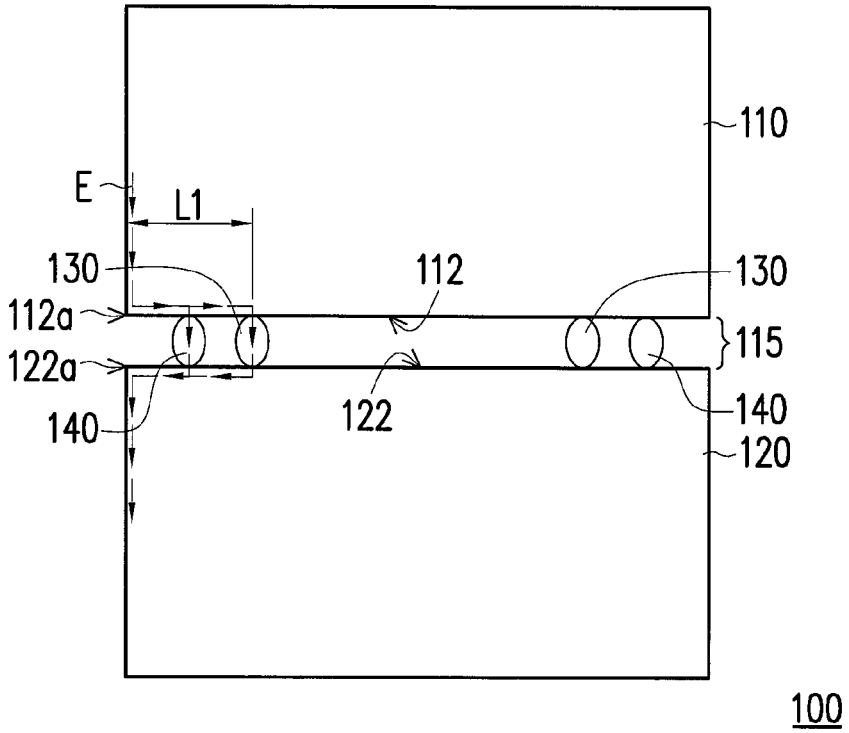
FIG. 1 is a schematic diagram illustrating an electronic device according to an embodiment of the invention.

FIG. 1 is a schematic diagram illustrating an electronic device according to an embodiment of the invention. Referring to FIG. 1, an electronic device 100 of the present embodiment includes a first casing 110 and a second casing 120 pivoted with each other, the first casing 110 includes a conductive material, and the second casing 120 includes a conductive material. The electronic device 100 further includes at least one first connecting unit 130 (two are illustrated) and at least one feeding unit 140 (two are illustrated). The first connecting units 130, for example, are pivoted units, the first casing 110 and the second casing 120 are pivoted with each other via the pivoted units (the first connecting units 130), and the first connecting units 130 conduct the first casing 110 and the second casing 120 with each other. The feeding units 140 are electrically connected to the first casing 110 and the second casing 120.

In the present embodiment, the electronic device 100, for example, is a notebook computer, the first casing 110, for example, is a metal shell of a display screen of the notebook computer, and the second casing 120, for example, is a metal shell of a host of the notebook computer. Under the above-mentioned configuration, the electronic device 100 conducts the first casing 110 and the second casing 120 with each other via the existing pivoted units (the first connecting units 130), configures the feeding units 140, which are electrically connected to the first casing 110 and the second casing 120, so as to form an antenna structure via the first casing 110, the second casing 120, the first connecting units 130 and the feeding units 140 for transmitting and receiving an electromagnetic signal, and delivers the electromagnetic signal via the feeding units 140. As a result, the electronic device 100 is not required to be configured with an additional antenna, and may avoid the conductive first casing 110 and second casing 120 from causing interference to a signal of the additional antenna, so as to enhance a signal transmission and reception ability of the electronic device 100.

In the present embodiment, a lateral side 112 of the first casing 110 and a lateral side 122 of the corresponding second casing 120 have a gap 115 there between, and the first connecting units 130 and the feeding units 140 are all disposed in the gap 115. Furthermore, the first casing 110 and the second casing 120, through the conduction of the feeding units 140, equal to a dipole antenna. The lateral side 112 of the first casing 110 has a distal end 112*a*, the lateral side 122 of the second casing 120 has a distal end 122*a*, and the distal end 112*a* of the lateral side 112 and the distal end 122*a* of the lateral side 122 are adjacent to the first connecting unit 130. A distance between the first connecting unit 130 and the distal end 112*a* of the lateral side 112 and a distance between the first connecting unit 130 and the distal end 122*a* of the lateral side 122 (labeled as L1) equal to $(n\times\lambda)/4$, wherein n is an integral number, $\lambda$ is a wavelength of the electromagnetic signal and the symbol "x" represents the multiplication sign, so that the first casing 110 and the second casing 120 are suitable for transmitting and receiving the electromagnetic signal. As shown in FIG. 1, under this configuration, distributions of current E of an antenna structure formed by the first casing 110, the second casing 120, the first connecting units 130 and the feeding units 140 at an edge of the first casing 110 and an edge of the second casing 120 are in comply with characteristics of the dipole antenna.

Figure 2:
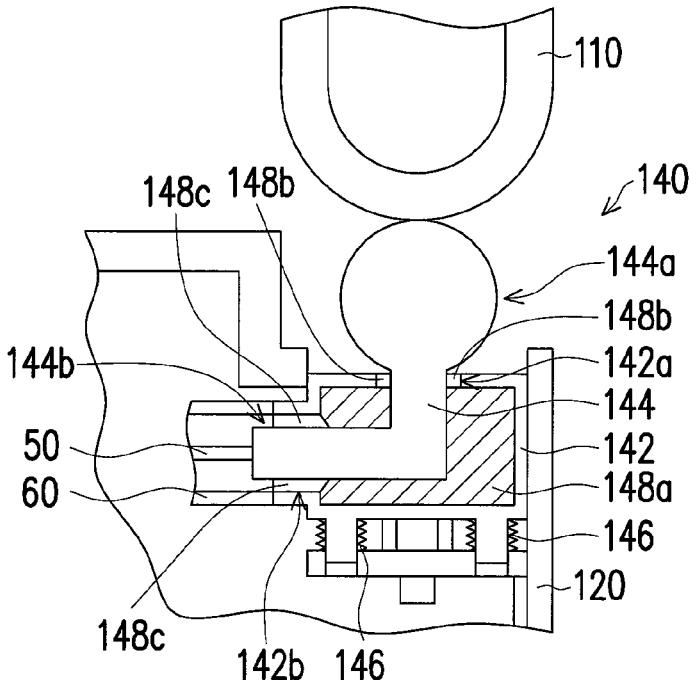
FIG. 2 is a partial enlarged diagram illustrating the electronic device of FIG. 1.

FIG. 2 is a partial enlarged diagram illustrating the electronic device of FIG. 1. Referring to FIG. 2, in detail, the feeding unit 140 of the present embodiment includes a base body 142, a conductive element 144 and at least one elastic element 146 (two are illustrated). The base body 142 is disposed within the second casing 120. The conductive element 144 is disposed on the base body 142, wherein a first end 144*a* of the conductive element 144 is in contact with the first casing 110, and a second end 144*b* of the conductive element 144 is connected to a feed line 50, so as to transmit the electromagnetic signal to a circuit within the second casing 120 through the feed line 50. The elastic element 146, for example, is a spring and connects between the base body 142 and the second casing 120, so that the conductive element 144 can be in continuous contact with the first casing 110 via an elastic force of the elastic element 146, and thereby enables the electromagnetic signal to be delivered through the conductive element 144 and the feed line 50, indeed. In the embodiment depicted by FIG. 2, the first end 144*a* of the conductive element 144, which is configured to contact the first casing 110 is, for example, a spherical structure; however, in other embodiments, the first end 144*a* may also be a structure of other suitable shape, such as a pillar structure or a sheet structure, and the invention is not limited thereto. Furthermore, under a condition when the first end 144*a* of the conductive element 144 is the sheet structure, the first end 144*a* is, for example, an elastic structure, so that the conductive element 144 can be in continuous contact with the first casing 110 via the elastic force of the elastic structure. In the present embodiment, the base body 142 of the feeding unit 140 is disposed within the second casing 120; however, the invention is not limited thereto; and in other embodiments, the base body 142 of the feeding unit 140 may also be disposed within the first casing 110.

In the present embodiment, the base body 142 includes a conductive material. The base body 142 is connected to a ground wire 60 and in contact with the second casing 120, so as to enable the second casing 120 to be grounded via the base body 142 and the ground wire 60.

As shown in FIG. 2, in the present embodiment, a portion of the conductive element 144 is located within the base body 142. The feeding unit 140 may further include an insulating element 148*a*, and the insulating element 148*a* is filled in the base body 142 so as to electrically isolate the conductive element 144 from the base body 142, and to firmly fix the conductive element 144 in the base body 142 for avoiding the conductive element 144 from being in conduct with the base body 142 and influencing the delivering of the electromagnetic signal. In addition, an insulating element 148*b* and an insulating element 148*c* may be respectively disposed at an opening 142*a* and an opening 142*b* of the base body 142, so that the conductive element 144 may be firmly fixed in the base body 142, and thereby ensure that the conductive element 144 passing through the opening 142*a* and the opening 142*b* is not to be in conduct with the base body 142. Furthermore, the insulating elements (148*a*, 148*b*, 148*c*) are configured to electrically isolate the conductive element 144 from the base body 142 and fix the conductive element 144 in the base body 142, and thereby capable of avoiding the delivering of electromagnetic signal to be influenced as the conductive element 144 and the base body 142 are being conducted with each other. In other embodiments, it is also possible not to fill the insulating element 148*a* in the base body 142, and the conductive element 144 is fixed in the base body 142 via the insulating element 148*b* and the insulating element 148*c*, and the invention is not limited thereto.

Figure 3:
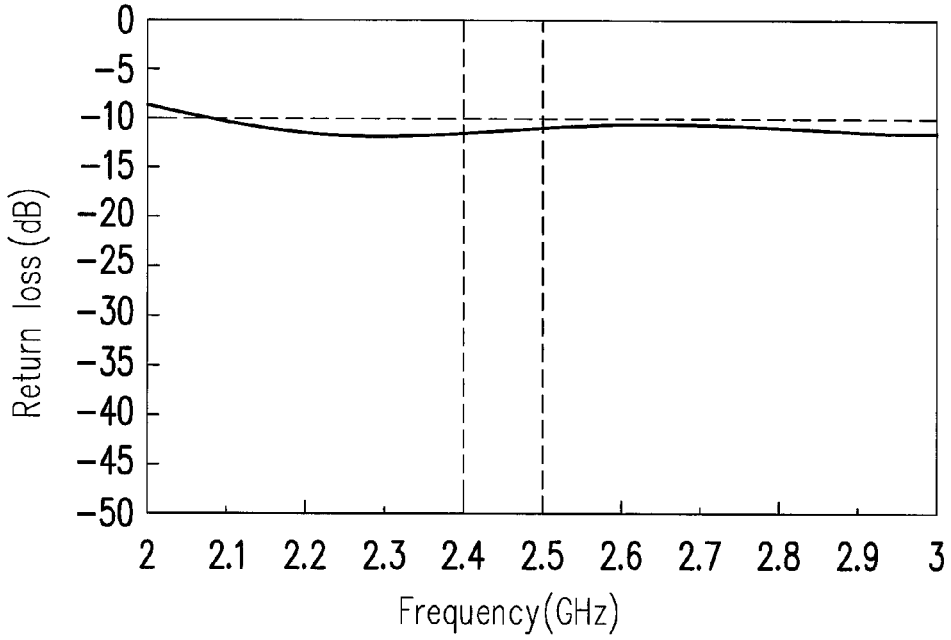
FIG. 3 illustrates a return loss curve of a dipole antenna formed by a first casing and a second casing of FIG. 1.
Figure 4:
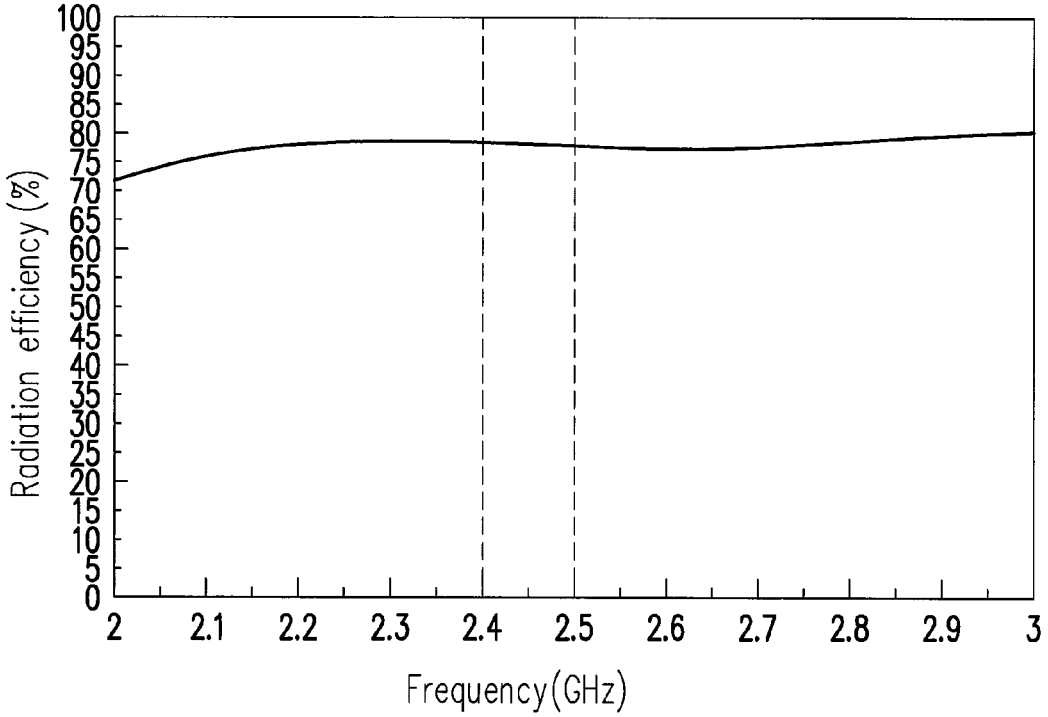
FIG. 4 illustrates a radiation efficiency diagram of the dipole antenna formed by the first casing and the second casing of FIG. 1.

FIG. 3 illustrates a return loss curve of a dipole antenna formed by a first casing and a second casing of FIG. 1. FIG. 4 illustrates a radiation efficiency diagram of the dipole antenna formed by the first casing and the second casing of FIG. 1. It may be seen from the return loss curve in FIG. 3 that, an operation bandwidth of the dipole antenna formed by the first casing 110 and the second casing 120 shown in FIG. 1 may cover an operating frequency band (2.4 to 2.5 GHz) required by a wireless local area network (WLAN). In addition, it may be seen from FIG. 4 that, within the operating frequency (2.4 to 2.5 GHz) required by the wireless local area network, a radiation efficiency of the dipole antenna formed by the first casing 110 and the second casing 120 shown in FIG. 1 is approximately between 78% to 80%, and in comply with a basic communication performance required for electronic products.

Figure 5:
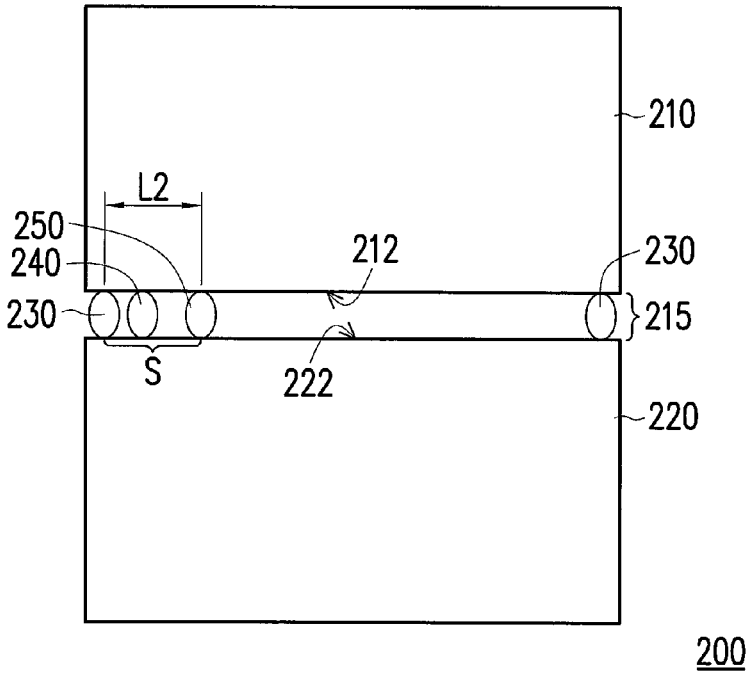
FIG. 5 is a schematic diagram illustrating an electronic device according to another embodiment of the invention.

FIG. 5 is a schematic diagram illustrating an electronic device according to another embodiment of the invention. Referring to FIG. 5, an electronic device 200 of the present embodiment includes a first casing 210 and a second casing 220 pivoted with each other, the first casing 210 includes a conductive material, and the second casing 220 includes a conductive material. The electronic device 200 further includes at least one first connecting unit 230 (two are illustrate), at least one feeding unit 240 (one is illustrated) and at least one second connecting unit 250 (one is illustrated). The first connecting units 230, for example, are pivoted units, the first casing 210 and the second casing 220 are pivoted with each other through the first connecting units 230, the first connecting units 230 conduct the first casing 210 and the second casing 220 with each other, the second connecting unit 250 conducts the first casing 210 and the second casing 220 with each other, the first casing 210, the second casing 220, the first connecting units 230 and the second connecting unit 250 form a slot S there between. The feeding unit 240 is electrically connected to the first casing 210 and the second casing 220.

In the present embodiment, the electronic device 200, for example, is a notebook computer, the first casing 210, for example, is a metal shell of a display screen of the notebook computer, and the second casing 220, for example, is a metal shell of a host of the notebook computer. Under the above-mentioned configuration, the electronic device 200 conducts the first casing 210 and the second casing 220 with each other via the existing pivoted units (first connecting units 230), configures the feeding unit 240 that connects to the first casing 210 and the second casing 220, and configures the second connecting unit 250 for conducting the first casing 210 and second casing 220, so as to enable the first casing 210 and the second casing 220 to be equivalent to a slot antenna with the formation of the slot S, thereby transmitting and receiving an electromagnetic signal, and delivering the electromagnetic signal via the feeding unit 240. As a result, the electronic device 200 is not required to be configured with an additional antenna, and may avoid the conductive first casing 210 and second casing 220 from causing interference to a signal of the additional antenna, so as to enhance a signal transmission and reception ability of the electronic device 200.

In the present embodiment, a lateral side 212 of the first casing 210 and a lateral side 222 of the corresponding second casing 220 have a gap 215 there between, and the first connecting units 230, the feeding unit 240 and the second connecting unit 250 are all disposed in the gap 215. Furthermore, a length L2 of the slot S formed in the gap 215 equals to $(n\times\lambda)/2$, wherein n is an integral number, $\lambda$ is a wavelength of the electromagnetic signal and the symbol "x" represents the multiplication sign, so that the first casing 210 and the second casing 220 are suitable for transmitting and receiving the electromagnetic signal. A configuration and a mode of action of feeding unit 240 of the present embodiment are similar to the configuration and the mode of action of the feeding unit 140 shown in FIG. 2, and thus are not to be repeated herein.

Figure 6:
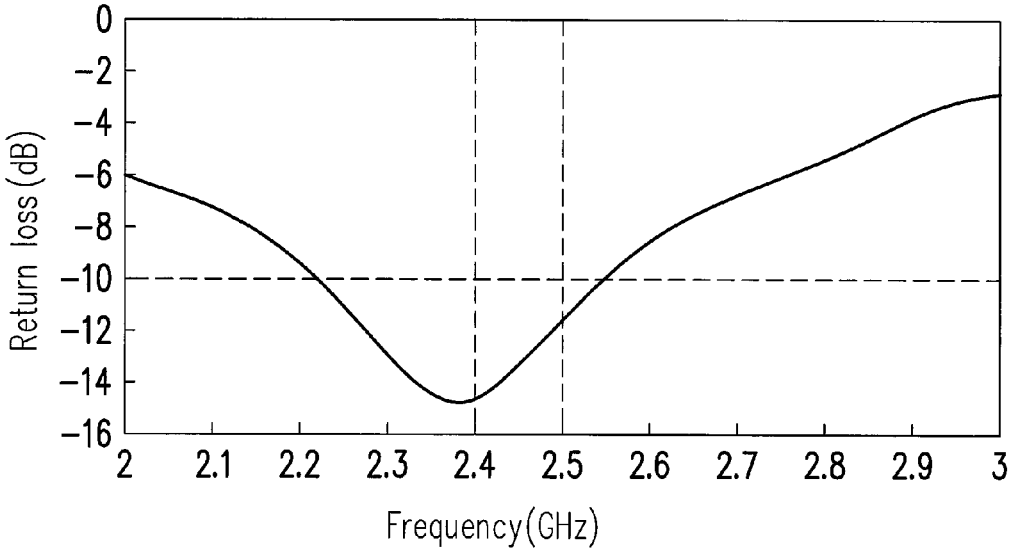
FIG. 6 illustrates a return loss curve of a slot antenna formed by a first casing and a second casing of FIG. 5.
Figure 7:
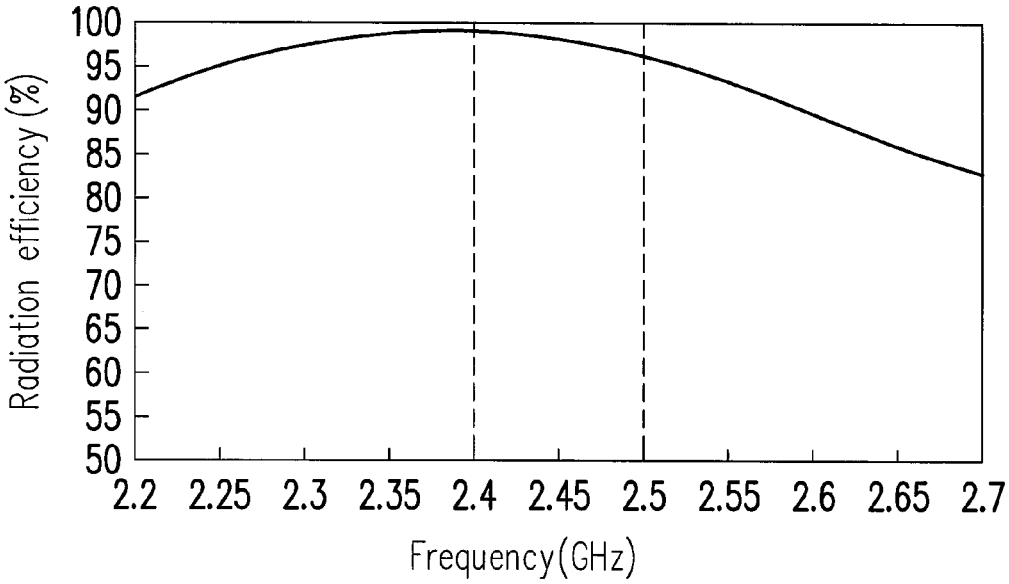
FIG. 7 illustrates a radiation efficiency diagram of the slot antenna formed by the first casing and the second casing of FIG. 5.

FIG. 6 illustrates a return loss curve of a slot antenna formed by a first casing and a second casing of FIG. 5. FIG. 7 illustrates a radiation efficiency diagram of the slot antenna formed by the first casing and the second casing of FIG. 5. It may be seen from the return loss curve in FIG. 6 that, an operation bandwidth of the slot antenna formed by the first casing 210 and the second casing 220 shown in FIG. 5 may cover an operating frequency band (2.4 to 2.5 GHz) required by a wireless local area network (WLAN). In addition, it may be seen from FIG. 7 that, within the operating frequency (2.4 to 2.5 GHz) required by the wireless local area network, a radiation efficiency of the slot antenna formed by the first casing 110 and the second casing 120 shown in FIG. 5 is approximately between 98% to 99%, and in comply with a basic communication performance required for electronic products.

Figure 8:
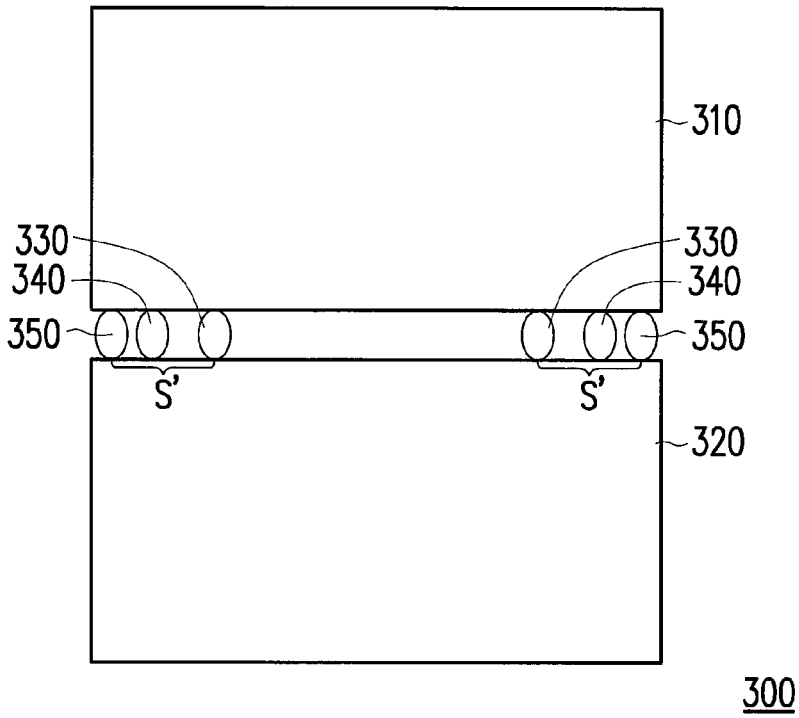
FIG. 8 is a schematic diagram illustrating an electronic device according to another embodiment.

In the embodiment shown in FIG. 5, an amount of the feeding unit 240 is one, an amount of the second connecting unit 250 is one, an amount of the slot S is one, and the second connecting unit 250 is located between two first connecting units 230 (e.g., the pivoted units); however, the invention is not intended to limit the amounts and the configurations of the feeding unit and the connecting unit and the amount of the slot, and it is to be described in detail below with an accompany of figure. FIG. 8 is a schematic diagram illustrating an electronic device according to another embodiment. Referring to FIG. 8, a difference between an electronic device 300 of the present embodiment and the electronic device 200 depicted by FIG. 5 is that, an amount of feeding units 340 is two, an amount of second connecting units 350 is two, wherein the two feeding units 340 are located between the two second connecting units 350, and two first connecting units 330 (e.g. pivoted units) are located between the two feeding units 340. A first casing 310, a second casing 320, the first connecting units 330 and the second connecting units 350 form two slots S' there between, so as to enable the first casing 310 and the second casing 320 to be equivalent to a slot antenna with the formation of the slots S'.

In summary, the electronic device of the invention conducts the first casing and the second casing with each other through the existing pivoted unit, and is configured with the feeding unit that connects the first casing and the second casing, so as to enable the first casing and the second casing to be equivalent to the dipole antenna and thereby capable of transmitting and receiving the electromagnetic signal, and to deliver the electromagnetic signal via the feeding unit. In addition, the connecting unit may further be configured between the first casing and the second casing, so that the first casing, the second casing, the pivoted unit and the connecting unit form the slot there between, so as to enable the first casing and the second casing to be equivalent to the slot antenna and thereby capable of transmitting and receiving the electromagnetic signal, and to deliver the electromagnetic signal via the feeding unit. As a result, the electronic device is not required to be configured with the additional antenna, and may avoid the conductive first casing and second casing from causing interference to the signal of the additional antenna, so as to enhance the signal transmission and reception ability of the electronic device.

It will be apparent to those skilled in the art that various modifications and variations can be made to the structure of the application without departing from the scope or spirit of the application. In view of the foregoing, it is intended that the application cover modifications and variations of this application provided they fall within the scope of the following claims and their equivalents.

What is claimed is:

1. An electronic device comprising:

a first casing, wherein the first casing comprises a conductive material;

a second casing, wherein the second casing comprises a conductive material;

at least one first connecting unit conducting the first casing and the second casing with each other; and at least one feeding unit electrically connected to the first casing and the second casing, wherein the feeding unit is directly connected to the first casing and directly connected to the second casing, the electronic device forms an antenna structure with the first casing, the second casing, the first connecting unit and the feeding unit, and transmits an electromagnetic signal via the feeding unit, wherein the feeding unit comprises:

a base body disposed within the second casing;

a conductive element disposed on the base body, wherein a first end of the conductive element is in contact with the first casing, a second end of the conductive element is connected to a feed line; and an elastic element connected between the base body and the second casing, wherein the conductive element is in continuous contact with the first casing via an elastic force of the elastic element.

2. The electronic device as recited in claim 1, wherein a lateral side of the first casing and a lateral side of the corresponding second casing have a gap there between, and the first connecting unit and the feeding unit are disposed in the gap.

3. The electronic device as recited in claim 2, wherein each lateral side has a distal end, the distal end is adjacent to the first connecting unit, and a distance between the first connecting unit and the distal end of each lateral side equals to $(n\times\lambda)/4$, wherein n is an integral number, and $\lambda$ is a wavelength of the electromagnetic signal.

4. The electronic device as recited in claim 1, further comprising at least one second connecting unit, wherein the second connecting unit conducts the first casing and the second casing with each other, and the first casing, the second casing, the first connecting unit and the second connecting unit form a slot there between.

5. The electronic device as recited in claim 4, wherein a length of the slot equals to $(n\times\lambda)/2$, wherein n is an integral number, and $\lambda$ is a wavelength of the electromagnetic signal.

6. The electronic device as recited in claim 1, wherein the first end of the conductive element is a spherical structure, a pillar structure or a sheet structure.

7. The electronic device as recited in claim 1, wherein the conductive element comprises an elastic structure.

8. The electronic device as recited in claim 1, wherein the base body comprises a conductive material, and the base body is connected to a ground wire and in contact with the second casing.

9. The electronic device as recited in claim 8, wherein the feeding unit further comprises:

an insulating element, wherein a portion of the conductive element is located within the base body, the insulating element is filled in the base body so as to electrically isolate the conductive element from the base body.

10. The electronic device as recited in claim 1, wherein the first connecting unit is a pivoted unit, and the first casing and the second casing are pivoted with each other through the pivoted unit.

* * * * *